US006391153B1

(12) United States Patent
Wikdahl

(10) Patent No.: US 6,391,153 B1
(45) Date of Patent: May 21, 2002

(54) PROCESS AND APPARATUS FOR THE PRODUCTION OF CELLULOSE PULPS OF IMPROVED QUALITY

(75) Inventor: Nils Anders Lennart Wikdahl, Bravallavagen 42, S-182 54 Djursholm (SE)

(73) Assignee: Nils Anders Lennart Wikdahl, Djursholm (SE)

( * ) Notice: Subject to any disclaimer, the term of this patent is extended or adjusted under 35 U.S.C. 154(b) by 0 days.

(21) Appl. No.: 09/600,109

(22) PCT Filed: Jan. 20, 1999

(86) PCT No.: PCT/SE99/00079

§ 371 Date: Jul. 11, 2000

§ 102(e) Date: Jul. 11, 2000

(87) PCT Pub. No.: WO99/36612

PCT Pub. Date: Jul. 22, 1999

(30) Foreign Application Priority Data

Jan. 20, 1998 (SE) ..... 9800124

(51) Int. Cl.[7] ..... D21D 5/02

(52) U.S. Cl. ..... 162/55; 55/349; 55/459.1; 209/728; 210/512.1; 210/512.2

(58) Field of Search ..... 162/4, 55; 55/349, 55/459.1; 209/727, 732, 728, 731; 210/512.1, 788, 512.2

(56) References Cited

U.S. PATENT DOCUMENTS

| | | | | |
|---|---|---|---|---|
| 2,975,896 A | | 3/1961 | Hirsch | 209/211 |
| 4,539,105 A | * | 9/1985 | Metcalf | 209/211 |
| 4,581,142 A | | 4/1986 | Fladby et al. | 210/512.1 |
| 4,696,737 A | * | 9/1987 | Bouchillon | 209/210 |
| 5,938,926 A | * | 8/1999 | McCarthy | 210/512.1 |

* cited by examiner

*Primary Examiner*—Dean T. Nguyen
(74) *Attorney, Agent, or Firm*—Leydig, Voit & Mayer, Ltd.

(57) ABSTRACT

A process and apparatus for the preparation of improved cellulose pulps is provided, in which defibered pulp is screened for removal of shives, and fibers with low bonding ability are removed in hydrocyclones, and rejects from the hydrocyclones are treated in refiner. In the process a specific combination of characteristics for the hydrocyclones and the volumetric flow is used in order to prepare pulps which give products of improved qualities, such as higher tensile strength, tear strength, light-scattering, surface smoothness, and especially low shive content.

40 Claims, 2 Drawing Sheets

PROCESS AND APPARATUS FOR THE PRODUCTION OF CELLULOSE PULPS OF IMPROVED QUALITY

FIELD OF THE INVENTION

The present invention relates to a process for the preparation of improved cellulose pulps giving papers with improved tensile strength, tear strength, light-scattering, and low shive content, and to an apparatus for the preparation thereof.

DESCRIPTION OF THE PRIOR ART

In the preparation of cellulose pulps, such as thermomechanical pulp (TMP) and chemithermomechanical pulp (CTMP) the fibers are laid free from each other and from lignin. The defibration process must be carried out in such a way that fiber cutting is avoided as much as possible, since long fibers give high tearing resistance in the paper that is prepared from the pulp. Fibers that still cling together form so-called shives which can cause web breaks in the paper machine or a lowering of the quality of the paper produced. In order to obtain high tensile strength, and to avoid fiber rising in offset printing when the paper is subjected to wetting by water, strong bonds between the fibers are required. To ensure fibers with good bonding ability, the fibers must be developed, i. e. treated so that the fiber wall is softened, and the surface of the fibers treated so that most of the outer thin layer, the primary wall, is removed and fibrils are loosened from the secondary wall. Thereby better contact between the secondary walls is obtained, and any residues of the lignin-rich hydrophobic middle lamella are removed. Flexible fibers are a prerequisite for achieving a paper with a smooth surface, suitable for coating, in particular for light-weight coated paper.

The pulp coming from the screening department contains both fibers that are well suited for the manufacture of paper, and some material that must either be further treated, such as incompletely treated fibers and shives, or be removed from the system, such as sand and bark particles. There is also a certain amount of fines, consisting of small pieces of the middle lamella and the primary wall, parts of fibrils from the secondary wall, parenchyme cells, and short pieces of cut fibers. Most of the fines material increases the strength and the light-scattering ability of the paper. In order to separate out fibers with good bonding ability it has been suggested to use screens or hydrocyclones. Screens separate according to particle size and hydrocyclones according to specific surface area. Screen rejects, however, also contain long fibers, which should be recovered. Rejects refining increases the bonding ability of the fibers. Factors particularly affecting the fiber fractionation capability of a hydrocyclone are pressure drop, rejects ratio, hydrocyclone geometry, and pulp slurry feed consistency.

SUMMARY OF THE INVENTION

The present invention refers to a process for the preparation of improved cellulose pulps in which defibered cellulose pulps are screened for removal of shives, fibers with low bonding ability are removed in hydrocyclones, and rejects from the hydrocyclone treatment are treated in reject refiner, which is characterized in the combination of the following characteristics:

a) the base end outflow diameter (Db) of the hydrocyclones being less than 14 mm b) the distance (Lu) between the inner base end outflow opening and the narrowest part of the apex opening being greater than 400 mm, and c) the ratio between the volumetric flow through the apex opening (Qa) and the volumetric flow through the inlet opening (Qf) of the hydrocyclones being controlled to lie within the interval 0.10–0.60.

According to this process it is possible to obtain satisfactory fractionation according to fiber bonding ability in hydrocyclones and prepare a pulp which yields a paper with improved tensile strength, tear strength, light-scattering, and surface smoothness.

In a modified version of the process of the invention, in which an arrangement of a centrally and axially placed blocking device (B) of circular cross section in the base end outflow opening is substituted for the parameter a) above, it is possible to further improve the process, so that it yields a paper which, in addition to improved tensile strength, tear strength, light scattering, and surface smoothness, also has a very low shive content.

This modified process thus refers to a process for the preparation of improved cellulose pulps in which defibered cellulose pulps are screened for removal of shives, fibers with low bonding ability together with remaining shives are removed in hydrocyclones, and rejects from the hydrocyclone treatment are treated in refiner, said process being characterized by the combination of the following characteristics:

a) the distance (Lu) between the inner base outflow opening and the narrowest part of the apex opening of the hydrocyclone being kept greater than 400 mm b) the ratio between the volumetric flow (Qa) through the apex opening and the volumetric flow (Qf) through the inlet openings of the hydrocyclones being regulated to lie within the interval of from 0.08 to 0.60 and c) the base outflow channel of the hydrocyclones being provided with a centrally and axially arranged blocking device (B) of circular cross section, the ratio of the diameter (Dd) of this blocking device to the diameter of the base outflow opening (Db) being kept within the interval of from 0.1 to 1.2.

The invention also refers to an apparatus for application of the process in which cellulose pulps are screened comprising hydrocyclones C for separation of fibers with low bonding ability and device RR for refining rejects from the hydrocyclones C, characterized by the combination of the following characteristics:

a) the base end outflow diameter Db of the hydrocyclones being less than 14 mm b) the distance Lu between the inner base end outflow opening and the narrowest part of the apex opening of the hydrocyclones being greater than 400 mm c) means P,V for establishing a volumetric flow Qa through the apex opening of the hydrocyclones that relates to the volumetric flow Qf through the inlet opening of the hydrocyclones such that the ratio Qa/Qf is within the interval 0.10–0.60.

The invention includes a modified apparatus for application of the process of the invention which results in a very low shive content, in which the base outflow channel of the hydrocyclones are provided with a centrally and axially arranged blocking device B of circular cross section. This modified apparatus thus refers to an apparatus for application of the process of the invention in which cellulose pulps are screened comprising hydrocyclones C for separation of fibers with low bonding ability and device RR for refining rejects from the hydrocyclones C, which apparatus is characterized by the combination of the following characteristics:

a) the distance Lu between the inner base end outflow openings and the narrowest part of the apex openings of the hydrocyclones being greater than 400 mm, b) means P,V for establishing a volumetric flow Qa through the apex openings of the hydrocyclones that relates to the volumetric flow Qf through the inlet openings of the hydrocyclones, such that the ratio Qa/Qf is within the interval of from 0.08 to 0.60, and c) the base end outflow channel of the hydrocyclones being provided with a centrally and axially arranged blocking device B of circular cross section, the ratio of the diameter Dd of this blocking device to the diameter Db of the base outflow opening being within the interval of from 0.1 to 1.2.

The expression "hydrocyclones" above and in the following is intended to mean one or several in parallel interconnected hydrocyclones including so-called multihydrocyclone aggregates.

Although especially applicable to TMP and CTMP the process and the apparatus of the invention can also be used with other types of cellulose pulps when improved bonding ability is desired, such as beaten chemical pulp and pulp made from recycled fibers.

The ratio Qa/Qf that should be within the interval 0.10–0.60, can preferably be kept within specific limits, depending of the pulp treated. For chemical pulps the ratio Qa/Qf is preferably 0.10–0.25, whereas the corresponding preferred interval for TMP is 0.20–0.40, and for CTMP 0.10–0.30.

The process of separation of fibers with low bonding ability can be carried out in one or in several hydrocyclone stages with different Qa/Qf-ratios in each stage. If, for example, two hydrocyclone stages are used, the ratio Qa/Qf in the first stage can be kept within the interval 0.10–0.40, whereas the ratio in the second stage can be kept on a lower level, such as 0.05–0.25.

As for the dimensions of the hydrocyclones for separation of fibers with low bonding ability, when no blocking device is used, the preferred ratios between the length (Lc) and the greatest cone diameter (Dc) is kept within the interval 5.2–6.5, the ratio between the base outflow diameter (Db) and the greatest cone diameter (Dc) is kept within the interval 0.10–0.20, the ratio between the apex outflow diameter (Da) and the greatest cone diameter (Dc) is kept within the interval 0.18–0.30, and the ratio between the base outflow diameter Db and the apex outflow diameter (Da>) is kept less than 1.

When a blocking device is used, the dimensions of the hydrocyclones are the same as described above with the exception of the ratio between the base outflow diameter (Db) and the greatest cone diameter (Dc) which is kept within the interval 0.10–0.26.

The ratio of the diameter (Dd) of the blocking device at the end (E) to the diameter (Db) of the base outflow opening is preferably kept within the interval of from 0.1 to 0.9 when the blocking device is arranged within a central outlet tube (T) at the base end of the hydrocyclone and extending axially from the base outflow opening into the hydrocyclone chamber. Such extension can preferably be from 0 to 5 times the diameter (Db) of the base outflow opening. It is also possible to arrange the blocking device within the central tube (T) at the base end of the hydrocyclone, extending axially with its end (E) within this tube at a distance of from 0 to 5 times the diameter (Db) of the base outflow opening in the flow direction from the base outflow opening. In the latter case it is also possible to make the central tube (T) widening in the flow direction, and the diameter (Dd) of the end (E) of the blocking device greater than the diameter (Db) of the base outflow opening.

According to the invention it is also suitable to treat rejects from the hydrocyclones for separation of fibers with low bonding ability in one or more hydrocyclones designed for separation of sand, bark and heavy particles, and this treatment can be carried out in one or more hydrocyclone stages. In this case it is preferred that the ratio Qa/Qf is kept within the interval 0.05–0.10, and the ratio between the base outflow diameter (Db) and the apex outflow diameter (Da) is kept greater than 1.

DESCRIPTION OF THE PREFERRED EMBODIMENTS

Figure 1:
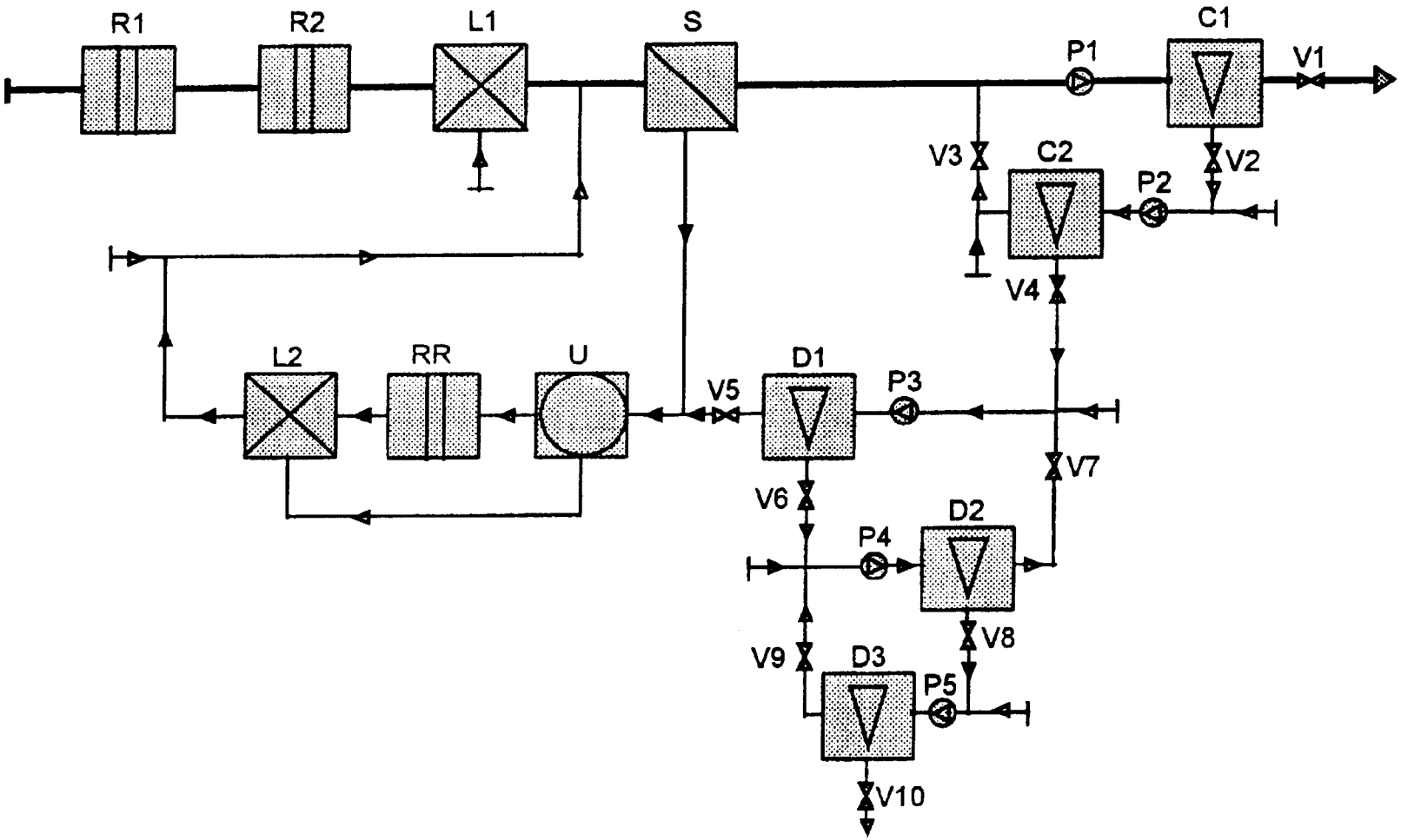
FIG. 1 illustrates schematically a plant for application of the process and apparatus of the invention, in which shives, fibers with unsatisfactory bonding ability, and bark are separated from the pulp.

FIG. 1 shows a mill system for the fractionation of thermomechanical pulp (TMP) in which pulp emerging from the refiners is treated for the separation of shives, insufficiently developed fibers, sand, and bark. Screened, washed and preheated chips are fiberized in two refiner stages R1 and R2 (each stage inay contain several refiners in parallel). The pulp is diluted with water to a consistency of 3–4%, and led to a latency chest L1, where various forms of mechanical stress (latency) in the fibers, caused by the refining process, are released The pulp is then pumped, at a consistency of about 1.5% through the screen S, where the screen plates have either holes or slots, and where most of the shives are separated Undeveloped fibers together with sand, bark, and any short shives that may have been accepted by the screen S, are separated from the developed fibers by the special hydrocyclones C1 and C2, forming a cyclone cascade and are withdrawn through the valve V4. Therefore, the material leaving through valve V1 consists mostly of well developed fibers of good bonding potential and fines. The pulp suspension is pumped through the cyclones by the pumps P1 and P2.

The fraction leaving C2 through the valve V4 contains undeveloped fibers, short shives, sand, and bark. It is passed to the cyclone cascade consisting of the stages D1, D2, and D3, fed by the pumps P3, P4, and P5. These cyclones are designed to give an efficient separation of sand and bark from the fiber material. The accepts from D1, leaving through the valve V5, join the shive-containing rejects from the screen S, and the combined stream is sent via the thickener U to a special rejects refiner RR.

Here, the fibers are given another treatment to enhance their bonding ability, and the fibers are fiberized. The pulp goes from the reject refiner to a latency chest L2, and from there back to the main stream, where it is again screened in S and fractionated in C1. The water withdrawn from the pulp in the thickener U can be used for dilution in the latency chest L2. Fibers and shives which were separated in the first pass, and which are still insufficiently developed or fiberized, are sent to the rejects refiner again. The final rejects from the cyclones in stage D3, leaving the system through the valve V10, contain sand and other heavy, non-fibrous material.

A system for chemimechanical pulp (CTMP) would be of essentially the same design—the main difference being in the treatment of the wood chips ahead of the main stream refiners, and in the way these refiners are run.

Cyclones for the Fractionation

The main stream hydrocyclones C1 and C2 separate primarily fibers of low bonding ability. In contrast to what takes place in screens, there is no fractionation according to fiber length in these cyclones. Also, sand and other types of heavy contaminants are separated, together with short shives. The combined process of fractionation according to bonding ability and separation of heavy contaminants is attained partly through the particular design of the cyclones, and partly by running the cyclones in a particular way.

As for the design of the cyclones, their size is quite different from what is common in forward hydrocyclones used for separating shives, sand, and bark from TMP. While the normal cyclones have a largest inner cone diameter Dc (See FIG. 2) of 150–300 mm and a length Lc of 1000–1200 mm, the corresponding dimensions of the fractionating hydrocyclones C1 and C2 are Dc=80 mm, and Lc=475 mm. Further, the diameters of both the inlet and the two outlets are of great importance. In the cyclones used in the mill and described in FIG. 1, the dimensions given in Table 1 and Table 2 below have proved to result in a satisfactory fractionation effect, while the heavy contaminants are also efficiently separated:

TABLE 1

| | |
|---|---|
| Dc = 80.0 mm | (Lu/Dc = 5.94) |
| Di = 13.5 mm | (two inlets) |
| Db = 12.0 mm | (Db/Dc = 0.150) |
| Da = 18.0 mm | (Da/Dc = 0.225) |

TABLE 2

| | |
|---|---|
| Dc = 80.0 mm | (Lu/Dc = 5.94) |
| Di = 13.5 mm | (two inlets) |
| Db = 18.0 mm | (Db/Dc = 0.22) |
| Da = 18.0 mm | (Da/Dc = 0.22) |
| Dd = 12.0 mm | (Dd/Da = 0.67) |

In hydrocyclones with dimensions in accordance with Table 1 and Table 2, and which are run at the conditions described in the following, most of the fibers with good bonding ability—i. e. flexible fibers of large specific surface—leave through the base opening, while undeveloped fibers pass mainly through the apex opening, along with sand and shives.

The ratio Db/Da is a very important design parameter. In conventional cyclones used for cleaning TMP and CTMP, this ratio is often close to 2, while it is less than 1 in the fractionating hydrocyclones used in the invention. In this respect, these cyclones resemble hydrocyclones used for separating light contaminants, e. g. plastics, from fibers, so-called reverse cyclones. However, when such hydrocyclones are run in the conventional way, the cleaned fibers (the accepts) leave through the apex outlet, and the contaminants (the rejects) leave through the base outlet together with a relatively small portion of the fibers. In the fractionating cyclones described here, the fibers follow a quite different flow pattern, as will be described in the following.

How much of the various fibers and contaminants that will leave through each of the two openings is determined by the distribution of the liquid in the cyclone. This distribution, also called the volume flow split, is given by the ratio Xq=Qa/Qf, where Qa is the volume flow rate through the apex opening, and Qf is the feed volume flow rate to the cyclone. Fibers with very strong bonding ability always go to the base opening, and fibers with very weak bonding ability always go to the apex opening in the cyclone designed according to the invention. However, the parameter Xq has a strong influence on how fibers with bonding ability between these two extremes are distributed. An increase in Xq, i. e. in the relative amount of the flow leaving through the apex, leads to a lower content of less developed fibers in the base fraction, while simultaneously more of the well developed fibers will leave in the apex fraction. With respect to the total result, it is normally advantageous to run the cyclones in stage C1 in such a manner that a small portion of the well developed fibers is allowed to go with the apex fraction, whereby the content of not fully developed fibers in the base fraction becomes very low. This will also ensure that practically all sand and bark, and other heavy is passed on to the hydrocyclone D1 through the valve V4 in FIG. 1. This amount depends of course on how one chooses to run the primary refiners R1 and R2. The valves V1, V2, V3, and V4 are used to regulate the flow distribution in the hydrocyclones C1 and C2.

In conventional systems for cleaning TMP and CTMP, Xq for the cyclones in the C1 position is normally around 0.10. For this reason the corresponding C2 stage is considerably smaller than it is in the fractionation system of the invention, since a much smaller flow is coming from C1. It is therefore not practically possible to obtain any significant fractionation in a given conventional installation just by increasing the apex flow rate in C1, quite apart from the fact that the cyclones themselves would be unsuited for the purpose. Another important process operation parameter is the consistency of the feed to the cyclones in C1 in the fractionation system of the invention. Generally, the fractionation efficiency is higher at lower than at higher consistencies. On the other hand, low consistencies also result in large flow volumes. The optimal feed consistency for the fractionating hydrocyclones will therefore usually lie in the range 0.3–1.2%.

With the cyclone dimensions and operating conditions given in the preceding paragraphs, the fiber fractionation occurs according to Table 3. This scheme shows by which cyclone opening the fibrous material will preferentially leave, according to their surface and flexibility. The more flexible the fibers are, and the larger their specific surface is, the stronger is their tendency to leave through the base outlet. Fibers which are flexible and also have a large surface (due to partially loosened fibrils in the fiber wall) have the best bonding ability.

TABLE 3.

| | | Fiber flexibility | |
|---|---|---|---|
| | | low | high |
| Specific surface | large | both to base and apex | nearly all to base |
| | small | nearly all to apex | mostly to apex |

fully developed fibers

Cyclones for the Separation of Contaminants of High Specific Weight

Figure 2:
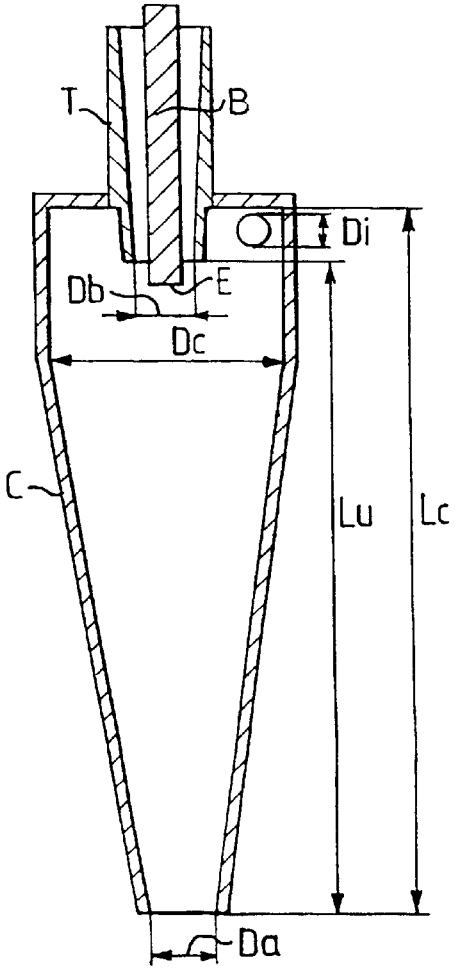
FIG. 2 shows schematically a side view of a hydrocyclone according to the invention.
Figure 4:
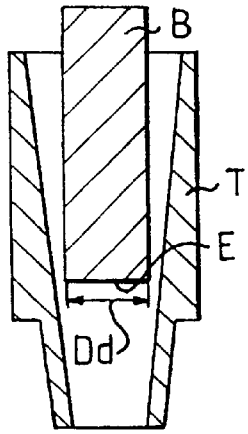
FIG. 4 shows a blocking device arranged within a central tube with one end located within the central tube, the diameter of this end of the blocking device being greater than the diameter of the base outflow opening.

The stream leaving the hydrocyclone C2 through valve V4 in FIG. 1 consists for the most part of undeveloped fibers and shives, together with sand, bark, and other contaminants which have a specific weight above that of the fibers. This heavy matter is separated from the fibrous material by the hydrocyclones in the stages D1, D2, and D3. These cyclones are designed differently from those in C1 and C2, and are run at other values of Xq, normally 0.05–0.10. Their main dimensions with reference to FIG. 2 are shown in Table 4.

TABLE 4

| | |
|---|---|
| Dc = 80.0 mm | (Lu/Dc = 5.94) |
| Di = 13.5 mm | (two inlets) |
| Db = 26.5 mm | (Db/Dc = 0.331) |
| Da = 18.0 mm | (Da/Dc = 0.225) |

The length of the cyclone chamber Lc is 475 mm. Thus, these cyclones are smaller than those usually applied for the separation of sand etc. in conventional systems, where e. g. Dc=150–300 mm and Lc=1000–1200 mm. In contrast to some of the fractionation hydrocyclones C1 and C2, their base outlets are wider than their apex outlets, i. e. Db/Da is greater than 1. There is no blocking device in the base end outflow of these hydrocyclones.

The invention is illustrated by the following examples.

EXAMPLE 1

Figure 5:
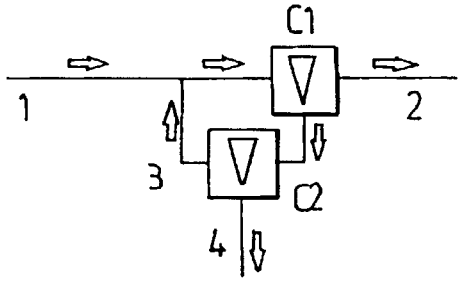
FIG. 5 shows schematically two hydrocyclone stages for separation of fibers with low bonding ability, connected to each other.
Figure 3:
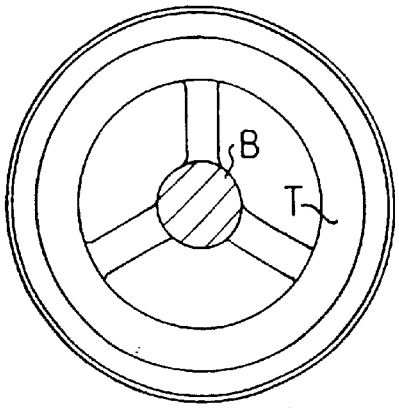
FIG. 3 shows a view of the hydrocyclone in FIG. 2, seen from the base end.

In a mill for producing newsprint TMP in accordance with FIG. 1, pulp samples were taken at two occasions with different sets of values for the volume flow split in the cyclones C1 and C2. The sampling positions are shown in FIG. 5. Each sample was tested for tensile index, tear index, and light scattering coefficient. The test results are given in Table 5 and Table 6, where D=tensile index Nm/g R=tear index $Nm^2/kg$ L=light-scattering coefficient $m^2/kg$ The volume flow splits Xq used in each test run are also shown in these tables

TABLE 5

| Pos. | D | R | L |
|---|---|---|---|
| 1 | 30.4 | 7.0 | 45.4 |
| 2 | 36.6 | 8.0 | 53.7 |
| 3 | 27.8 | 6.4 | 45.7 |
| 4 | 9.0 | 2.2 | 32.3 |

Xq in C1 = 0.24
Xq in C2 = 0.10

TABLE 6

| Pos. | D | R | L |
|---|---|---|---|
| 1 | 28.6 | 6.8 | 47.1 |
| 2 | 38.5 | 7.5 | 53.6 |
| 3 | | not observed | |
| 4 | 7.9 | 1.9 | 31.5 |

Xq in C1 = 0.20
Xq in C2 = 0.08

The data in the tables show clearly that at both the volume flow splits used, the pulp treated in accordance with the invention in the main line—position 2 —has considerably higher, i. e. better, values for all three quality parameters than the incoming pulp—position 1 —and that the pulp which is passed on for further treatment—position 4 —is much weaker and gives less light-scattering.

EXAMPLE 2

The large difference in strength between the base and apex fractions from the fractionating hydrocyclones has been suggested to be due to a much lower content of fines in the apex fraction, and also that the fines there probably have less strength-increasing increasing capacity than those in the base fraction. This hypothesis can, however, be rejected, which is shown in the following tests:

Samples were taken from the base and apex fractions in the cyclone stage C1 in the same production line as that described above, and the tensile index was measured both in the whole sample and in samples partitioned according to fiber length in a Bauer-McNett fractionator. The 16–30 mesh fraction, i. e. fibers which have passed through the 16 mesh screen but are retained on the 30 mesh screen, contains neither shives nor fines (shives are retained by 16 mesh, while fines pass through 30 mesh). The tensile index of this fraction, which in the test comprised about 15% of the whole sample, is considered to be a good measure of how well developed the fibers are. The observed tensile index values, which are shown in Table 7 below, clearly show that the whole sample as well as the 16–30 and the 50–200 mesh fractions from the apex stream were of inferior quality, as compared to those of the base stream. It is therefore obvious, that the strength difference between the base and apex streams is not caused by differences in the amount or the quality of the fines.

TABLE 7

| Tensile index of pulp from C1, Nm/g | | |
|---|---|---|
| Fraction | Base | Apex |
| Whole sample | 38.6 | 21.5 |
| 16–30 mesh | 9.0 | 4.8 |
| 50–200 mesh | 54.4 | 20.5 |

EXAMPLE 3

Figure 6:
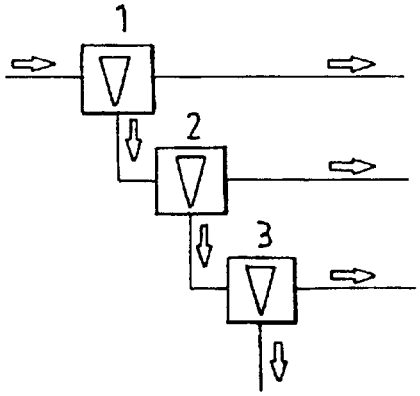

TMP for newsprint was fractionated in a laboratory test in order to determine the amount of fibers with low bonding ability in the pulp and therewith the need of fractionation and size of subsequent refining equipment. The fractionation was carried out in three stages in accordance with FIG. 6. The hydrocyclones used were of the same type as the hydrocyclones C, described in FIG. 1. Samples were taken and tested for tensile index. For these trials, the fiber flow split Xm is also reported in addition to the volume flow split Xq. Xm is defined as the ratio between the apex pulp flow rate and the feed pulp flow rate of the cyclone. The results are shown in Table 8.

TABLE 8

| Tensile index in TMP for newsprint, Nm/g | | | |
|---|---|---|---|
| Cycl. | Feed | Base | Apex |
| 1 | 32.7 | 47.4 | 21.4 |
| 2 | | 40.2 | 14.0 |
| 3 | | 39.9 | 8.5 |

Xm in 1 = 0.50
Xm in 2 = 0.64
Xm in 3 = 0.78
Xq = 0.28 in all stages

Table 8 shows that when newsprint pulp was fractionated, the base fractions from all three stages had a higher tensile index than the original pulp fed to cyclone 1. The apex fraction from cyclone 3 contained 25% of the pulp flow to the system, and had a very low tensile index. This fraction could be assumed to consist mainly of fibers of very low bonding ability in need of further treatment in refiners.

EXAMPLE 4

TMP for LWC (light weight coated paper) was fractionated in a laboratory test in order to determine the amount of fibers with low bonding ability in the pulp and the need of fractionation and size of subsequent refining equipment. The fractionation was carried out in accordance with FIG. 6. The hydrocyclones used were of the same types as the hydrocyclones C, described in FIG. 1. Samples were taken and tested for tensile index and the fiber split Xm was reported. Pulp for LWC is normally defibrated at a much higher energy input to the main line refiners than is newsprint TMP, which results in a larger proportion of fully developed fibers. The effect of fractionation therefore could be expected to be lower. The result of the test is shown in Table 9.

TABLE 9

| Tensile index in TMP for LWC, Nm/g | | | |
|---|---|---|---|
| Cycl. | Feed | Base | Apex |
| 1 | 46.6 | 55.3 | 39.5 |
| 2 | | 49.9 | 30.5 |
| 3 | | 44.1 | 19.4 |

Xm in 1 = 0.45
Xm in 2 = 0.56
Xm in 3 = 0.64
Xq = 0.32 in all stages

The results in Table 9 show surprisingly, that not only the base fraction of cyclone 1, but also the base fraction of cyclone 2, had a higher tensile index than did the pulp feed to the system. The rejects from cyclone 3, which comprised 16% of the pulp feed to the system, showed a considerably lower tensile index than the original pulp. Consequently, fractionation according to the invention is advantageous even for TMP used for LWC.

In the above examples the invention is described using a separate refiner for the rejects from the hydrocyclones. According to the invention it is, however, also possible to return the rejects from the hydrocyclones to the refiners in the main line.

EXAMPLE 5

In a mill for producing newsprint TMP in accordance with FIG. 1, pulp samples were taken from the base outflow and from the apex outflow of the hydrocyclone C1 without blocking device (A) and with a blocking device (B). The samples were tested for tensile index, light-scattering coefficient, and shive separation. Inlet consistency was 0.52% and Xq=0.25. In the test (A) the hydrocyclone had the measures given in Table 1, whereas in the test (B) the hydrocyclone with a blocking device had the dimension given in Table 2 and the end of the blocking device at the same level as the base outflow opening. The results are given in Table 10, in which D=tensile index Nm/g, L=light-scattering coefficient $m^2/kg$, and S=shive separation efficiency in % for shives of length 2 and 4 mm, respectively:

TABLE 10

| | S | | | |
|---|---|---|---|---|
| Cyclone | 2 mm | 4 mm | D | L |
| A | 31 | 20 | 10.1 | 7.4 |
| B | 52 | 99 | 12.1 | 13.9 |

The data in the Table show clearly that the pulp treated according to the modification (B) has considerably improved shive separation efficiency when a blocking device as described above is used. There is also an improvement in tensile strength and light-scattering coefficient.

What is claimed is:

1. A process for preparing improved cellulose pulps comprising the steps of:

screening defibered cellulose pulps to remove shives;

providing at least one hydrocyclone having an apex opening and a base end outflow opening with a diameter (Db), wherein:

a) the base end outflow diameter (Db) of the hydrocyclones is less than 14 mm;

b) the distance (Lu) between the inner base end outflow opening and the narrowest part of the apex opening is greater than 400 mm, and regulating the volumetric flow (Qa) through the apex opening and the volunetric flow (Qf) through the inlet opening or openings of each hydrocyclone so that the ratio Qa/Qf is from 0.08 to 0.60;

removing fibers having low bonding ability through said apex opening and refining said fibers.

2. The process of claim 1, in which the rejects from the hydrocyclone treatment are treated in a separate refiner stage.

3. The process of claim 1 in which the cellulose pulp is chemical pulp and the ratio Qa/Qf is kept within the interval 0.10–0.25 in the main fractionation stage.

4. The process in claim 1, in which the cellulose pulp is thermomechanical pulp (TMP) and the ratio Qa/Qf is kept within the interval 0.20–0.40.

5. The process of claim 1, in which the cellulose pulp is chemimechanical pulp (CTMP) and the ratio Qa/Qf is kept within the interval 0.10–0.30.

6. The process of claim 1, in which the separation of fibers with low bonding ability is carried out in several different hydrocyclone stages.

7. The process of claim 6, in which two hydrocyclone stages are used, whereby Qa/Qf in the first stage is kept within the interval 0.10–0.40, and Qa/Qf in the second stage is kept within the interval 0.05–0.25.

8. The process of claim 1, in which the ratio between the length (Lc) of the hydrocyclone chamber and the greatest inner cone diameter (Dc) of the hydrocyclones is kept within the interval 5.2–6.5.

9. The process of claim 1, in which the ratio between the base outflow diameter (Db) and the greatest cone diameter (Dc) of the hydrocyclones is kept within the interval 0.10–0.20.

10. The process of claim 1, in which the ratio between the apex outflow diameter (Da) and the greatest cone diameter (Dc) of the hydroclones is kept within the interval 0.18–0.30.

11. The process of claim 1, in which the ratio between the base outflow diameter (Db) and the apex outflow diameter (Da) of the hydrocyclones is kept less than 1.

12. The process of claim 1, in which rejects from the hydrocyclones for separation of fibers with low binding ability is treated in hydrocyclones designed for separation of sand, bark, and heavy particles.

13. The process of claim 12, in which the ratio between the volumetric flow through the apex opening (Qa) and the volumetric flow through the inlet opening (Qf) in the hydrocyclones for separation of heavy particles is kept within the interval 0.05–0.10, and the ratio between the base outflow diameter (Db) and the apex outflow diameter (Da) is kept greater than 1.

14. The process of claim 12, in which the separation of heavy particles is carried out in several hydrocyclone stages.

15. A process according to claim 1, wherein said ratio Qa/Qf is from 0.10 to 0.60.

16. The process according to claim 1, further comprising the step of returning the fibers with low bonding ability to the screening step.

17. The process according to claim 1, further comprising the step of collecting fibers with high bonding ability from said hydrocyclone for use in making paper.

18. The process according to claim 1, in which the cellulose pulp is thermomechanical pulp (TMP) and the ratio Qa/Qf is kept within the interval 0.15–0.35.

19. A process for preparing improved cellulose pulps comprising the steps of:

screening defibered cellulose pulps to remove shives;

providing at least one hydrocyclone having an apex opening and a base end outflow opening with a diameter (Db), wherein a distance (Lu) between the inner base end outflow opening and the narrowest part of the apex opening is greater than 400 mm, and regulating the volumetric flow (Qa) through the apex opening and the volumetric flow (Qf) through the inlet opening or openings of each hydrocyclone so that the ratio Qa/Qf is from 0.08 to 0.60;

removing fibers having low bonding ability through said apex opening and refining said fibers; and providing a respective blocking device (B) of circular cross section mounted centrally and axially at the base end outflow channel of the hydrocyclone, the ratio of the diameter (Dd) at an end (E) of this blocking device to the diameter (Db) of the base outflow opening being from 0.1 to 1.2.

20. The process of claim 19, in which the ratio of the diameter (Dd) of the blocking device to the diameter (Db) of the base outflow opening is being kept within the interval of from 0.1 to 0.9.

21. The process of claim 20, in which the blocking device is arranged within a central outlet tube (T) at the base end of the hydrocyclone, and extending axially from the base outflow opening into the hydrocyclone chamber.

22. The process of claim 21, in which the blocking device is arranged extending a distance of 0 to 5 times the diameter of the base outflow opening (Db) into the hydrocyclone chamber.

23. The process of claim 19, in which the blocking device is arranged within a central outlet tube (T) at the base end of the hydrocyclone and extending axially with its end (E) within this tube.

24. The process of claim 23, in which the end (E) of the blocking device is arranged at a distance of 0 to 5 times the diameter of the base outflow opening (Db) in the flow direction from the base outflow opening.

25. The process of claim 23, in which the central blue tube (T) is widening in the flow direction, and the diameter (Dd) of the end (E) of the blocking device is kept greater than the diameter (Db) of the base outflow opening.

26. An apparatus for processing cellulose pulps comprising at least one hydrocyclone for separation of fibers with low bonding ability and a device for refining rejects from the hydrocyclones wherein:

a) the base end outflow diameter Db of the hydrocyclones is less than 14 mm b) the distance Lu between the inner base end outflow opening and the narrowest part of the apex opening of the hydrocyclones is greater than 400 mm c) means for establishing a volumetric flow Qa through the apex opening of the hydrocyclones that relates to the volumetric flow Qf through the inlet opening or openings of each hydrocyclone, such that the ratio Qa/Qf is within the interval 0.08–0.60.

27. An apparatus according to claim 26, in which the ratio between the length Lc of the hydrocyclone chamber and the greatest cone diameter Dc of the hydrocyclones is within the interval 5.2–6.5, the ratio between the base outflow diameter Db and the greatest cone diameter Dc of the hydrocyclones is within the interval 0.10–0.20, the ratio between the apex outflow diameter Da and the greatest cone diameter Dc of the hydrocyclones is within the interval 0.18–0.30, and the ratio between the base outflow diameter Db and the apex outflow diameter Da is less than 1.

28. An apparatus according to claim 26, which also includes hydrocyclones D for the separation of sand, bark and heavy particles for treatment of rejects from the hydrocyclones C.

29. The apparatus according to claim 26 wherein said ratio Qa/Qf is from 0.10 to 0.60.

30. An apparatus for processing cellulose pulps comprising at least one hydrocyclone for separation of fibers with low bonding ability and a device for refining rejects from the hydrocyclones wherein:

a) the distance Lu between the inner base end outflow opening and the narrowest part of the apex opening of the hydrocyclones is greater than 400 mm b) means for establishing a volumetric flow Qa through the apex opening of the hydrocyclones that relates to the volumetric flow Qf through the inlet opening or openings of each hydrocyclone, such that the ratio Qa/Qf is within the interval 0.08–0.60; and c) a blocking device B mounted generally centrally and axially in the base endflow channel said hydrocyclone, the blocking device having a circular cross section, the ratio of a diameter Dd of the blocking device relative to the diameter Db of the base outflow opening being from 0.1 to 1.2.

31. The apparatus of claim 30, in which in which the ratio of the diameter Dd of the blocking device at the end E to the diameter Db of the base outflow opening is being kept within the interval from 0.1 to 0.9.

32. The apparatus of claim 31, in which the blocking device B is arranged within a central outlet tube T at the base end of the hydrocyclone, and extending axially from the base outflow opening into the hydrocyclone chamber.

33. The apparatus according to claim 32, in which the end E of the blocking device B is arranged at a distance of 0 to 5 times the diameter Db of the base outflow opening into the hydrocyclone chamber.

34. An apparatus according to claim 30, in which the blocking device B is arranged within a central outlet tube T at the base end of the hydrocyclone and extending axially with its end E within this tube.

35. The apparatus of claim 34, in which the end E of the blocking device is arranged at a distance of 0 to 5 times the diameter Db of the base outflow opening in the flow direction from the base outflow opening.

36. The apparatus of claim 34, in which the central tube T is widening in the flow direction, and the diameter Dd of the end E of the blocking device is kept greater than the diameter of the base outflow opening Db.

37. An apparatus according to claim 30, in which the ratio between the length Lc of the hydrocyclone chamber and the greatest cone diameter Dc of the hydrocyclones is within the interval 5.2–6.5, the ratio between the base outflow diameter Db and the greatest cone diameter Dc is within the interval 0.15–0.35, the ratio between the apex outflow diameter Da and the greatest cone diameter Dc is within the interval 0.18–0.30, and the ratio between the base outflow area and the apex outflow area is less than 1.

38. An apparatus for processing cellulose pulp comprising:

at least one hydrocyclone having a base end outflow opening for outputting accept fibers having high bonding ability, the base outflow opening having a diameter Db, an apex opening for outputting reject fibers having low bonding ability, and at least one inlet opening, wherein Db is less than 14 mm, a distance Lu between the inner base end outflow opening and a narrowest part of the apex opening is greater than 400 mm; and at least one pump operable to establish a volumetric flow Qf through said at least one inlet opening of the hydrocyclone sufficient to cause a volumetric flow Qa through the apex opening such that a ratio Qa/Qf is from 08 to 0.60; and a refiner for refining said rejects.

39. The apparatus of claim 38, wherein said at least one pump is operable to establish a volumetric flow Qf through said at least one inlet opening of the hydrocyclone sufficient to cause a volumetric flow Qa through the apex opening such that a ratio Qa/Qf is from 0.10 to 60.

40. An apparatus for processing cellulose pulp comprising:

at least one hydrocyclone having a base end outflow opening for outputting accept fibers having high bonding ability, the base outflow opening having a diameter Db, an apex opening for outputting reject fibers having low bonding ability, and at least one inlet opening, wherein a distance Lu between the inner base end outflow opening and a narrowest part of the apex opening is greater than 400 mm; and at least one pump operable to establish a volumetric flow Qf through said at least one inlet opening of the hydrocyclone sufficient to cause a volumetric flow Qa through the apex opening such that a ratio Qa/Qf is from 0.08 to 0.60; and a refiner for refining said rejects; and a blocking device mounted generally centrally and axially in the base endflow opening, the blocking device having a circular cross section and a diameter Dd such that Dd/Db is from 0.1 to 1.2.

* * * * *